United States Patent [19]

Kauffman et al.

[11] Patent Number: 4,605,421

[45] Date of Patent: Aug. 12, 1986

[54] PROCESS FOR THE PREPARATION OF A CARBONACEOUS-DERIVED SOLID FUEL PRODUCT

[75] Inventors: Jim W. Kauffman; William C. Laughlin, both of Edmond; Roger A. Baldwin, Oklahoma City, all of Okla.

[73] Assignee: Kerr-McGee Chemical Corporation, Oklahoma City, Okla.

[21] Appl. No.: 648,471

[22] Filed: Sep. 10, 1984

[51] Int. Cl.[4] ..... C10L 9/00; C10L 9/08

[52] U.S. Cl. ..... 44/1 F; 44/23; 44/6; 44/1 G; 201/8; 201/45

[58] Field of Search ..... 44/1 F, 23, 6; 208/8 R

[56] References Cited

U.S. PATENT DOCUMENTS

| | | | |
|---|---|---|---|
| 1,922,391 | 8/1933 | Odell | 44/6 |
| 2,125,753 | 8/1938 | Spencer | 44/6 |
| 3,655,350 | 4/1972 | Utley | 44/23 |
| 3,985,516 | 10/1976 | Johnson, et al. | 44/6 |
| 3,985,517 | 10/1976 | Johnson | 44/6 |
| 4,119,409 | 10/1978 | Aoki et al. | 44/1 R |
| 4,232,539 | 2/1981 | McMahon et al. | 44/1 B |
| 4,264,333 | 4/1981 | Shaw et al. | 44/6 |
| 4,265,637 | 5/1981 | Anderson | 44/31 |
| 4,302,209 | 11/1981 | Baker et al. | 44/23 |
| 4,402,707 | 9/1983 | Wunderlich | 44/6 |
| 4,403,996 | 9/1983 | Matsuura et al. | 44/1 G |
| 4,412,840 | 11/1983 | Cooksel | 44/23 |
| 4,461,627 | 7/1984 | Yokoyama et al. | 44/23 |
| 4,511,363 | 4/1985 | Nakamura et al. | 44/6 |

*Primary Examiner*—Andrew H. Metz
*Assistant Examiner*—Helane Myers
*Attorney, Agent, or Firm*—William G. Addison; John P. Ward

[57] ABSTRACT

A method for producing carbonaceous-derived solid fuel products comprising subjecting a carbonaceous material to a temperature sufficient to remove a substantial portion of water inherent in said carbonaceous material, pyrolyzing at least a portion of the dried carbonaceous material to form a carbonaceous-based char material and simultaneously recover carbonaceous-based tar by-products and contacting at least one material selected from the group consisting of the dried carbonaceous material and the carbonaceous-based char material with a water-in-tar emulsion, said emulsion being prepared from said recovered carbonaceous-based tar by-products.

14 Claims, 1 Drawing Figure

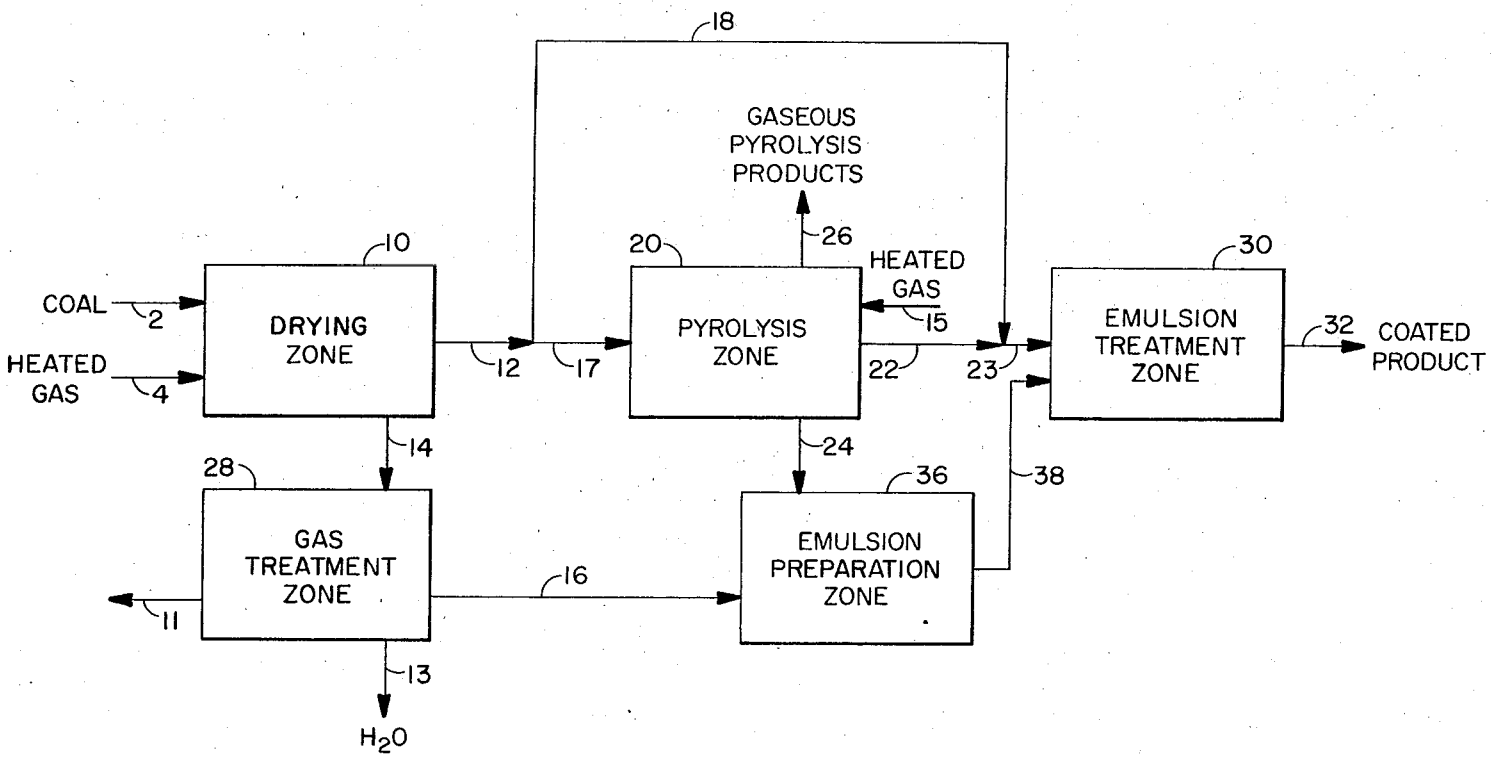
COAL
2
HEATED GAS
4
DRYING ZONE
10
12
17
20
PYROLYSIS ZONE
HEATED GAS
15
22
23
GASEOUS PYROLYSIS PRODUCTS
26
18
24
EMULSION PREPARATION ZONE
36
38
EMULSION TREATMENT ZONE
30
COATED PRODUCT
32
14
GAS TREATMENT ZONE
28
16
11
13
$H_2O$

PROCESS FOR THE PREPARATION OF A CARBONACEOUS-DERIVED SOLID FUEL PRODUCT

FIELD OF THE INVENTION

The present invention relates to a novel process for the preparation of carbonaceous-derived, solid fuel products. More particularly, the present invention relates to a process for the preparation of carbonaceous-derived solid fuel products characterized by their enhanced heating values and reduced tendencies to ignite spontaneously and to undergo particle size degradation. The present invention also relates to novel solid fuel products prepared in accordance with the novel process.

BACKGROUND OF THE INVENTION

Various solid carbonaceous materials, e.g., coals such as anthracite, bituminous, subbituminous, lignites and brown coals, are employed as fuels in a number of applications. One of the largest consumers of such materials is the utility industry for use in the generation of electric power. Due to a general decrease in the economic growth in this industry, however, an evergrowing demand is being made of the producers and suppliers of coal to provide coals of greater heating value per unit weight to assist the utility industry in reducing the costs of electrical power generation.

Generally, as-mined coals, and particularly those coals ranked below bituminous, have nominal heating values of approximately 8,000 Btu per pound. It is known that, by drying the coal to remove a substantial proportion of the so-called inherent moisture or water retained within the ultra-fine structure of the coal, the heating value per unit weight of the coal can be increased significantly. However, drying of coal, while effecting the desired increase in its heating value, also renders the dried coal more easily oxidized and, therefore, more susceptible to undergoing spontaneous combustion, making the transportation and storage of the dried coal difficult at best. Additionally, the dried coal is more friable than its precursor as mined coal, resulting in an increase in particle size degradation of the dried coal during the subsequent handling thereof.

It also is known to pyrolyze as-mined coal at low temperatures [e.g., 500° C. to 750° C.] to form chars for use as fuels in plants for generating electric power. Again, although, such chars exhibit increased heating valves, these chars suffer from substantially the same difficulties in transportation, storage and handling as the dried coals.

Thus, there, exists a present need for an efficient and economical process for preparing a carbonaceous fuel of enhanced heating value but having a diminished capacity to ignite spontaneously and to generate fines during the subsequent transportation, storage and handling thereof. The process of the present invention fulfills this need.

BRIEF DESCRIPTION OF THE DRAWING

The single drawing is a schematic of the process of the present invention, illustrating in particular the principal operative steps of a preferred embodiment of said invention.

SUMMARY OF THE INVENTION

It has now been discovered that particulated carbonaceous products suitable for use as fuel materials and having enhanced heating values and substantially reduced tendencies to ignite spontaneously and undergo size degradation during the transportation, storage and handling thereof can be readily prepared by the process of the present invention as described in greater detail and particularity hereinbelow.

In its broadest aspects, the process of the present invention comprises heating a solid particulated carbonaceous material at temperatures sufficient to remove and recover a substantial portion of the moisture (i.e., water) inherent in said material and to provide a dried particulated carbonaceous material having a reduced water content. This dried particulated material, or at least a portion thereof, then is subjected to pyrolysis at temperatures sufficient to pyrolyze said dried particulated carbonaceous material, or said portion thereof, to a carbonaceous-based particulated char and to maximize the removal and recovery of carbonaceous-based tar by-products therefrom.

The inherent water and carbonaceous-based tar by-products individually recovered from the drying of solid particulated carbonaceous material and the pyrolysis of at least a portion thereof, respectively, then are combined in predetermined proportions to provide a water-in-tar emulsion. This emulsion then is contacted with at least one material selected from the group consisting of said dried particulated carbonaceous material and said carbonaceous-based particulated char to form a coating of the tar by-products on said material.

In a preferred embodiment of the present invention, only a portion of the dried particulated carbonaceous material is subjected to pyrolysis to provide the necessary carbonaceous-based tar by-products. In this preferred embodiment, the remaining portion of dried particulated carbonaceous material and the subsequently recovered pyrolyzed portion thereof, i.e., the carbonaceous-based particulated char, then are combined to form an admixture. The final fuel product is prepared by contacting this admixture with the water-in-oil emulsion to provide a coating on said admixture of the tar by-products in said emulsion.

The present invention further relates to particulated carbonaceous fuel products prepared in accordance with the process described herein.

DETAILED DESCRIPTION OF THE INVENTION

As disclosed above, the single FIGURE is a schematic drawing of the process of the present invention, illustrating in particular the principal operative steps of the preferred embodiment of the invention. Referring to this single drawing, a solid carbonaceous material such as, for example, a subbituminous, lignite or brown coal, is crushed or ground (by means not shown) to particle sizes of about two inches and less and introduced into drying zone 10 through conduit 2. In drying zone 10, the particulated coal, which can contain from about 20% to about 70% by weight of so-called inherent moisture or bed moisture (i.e., water), is heated to temperatures ranging from about 100° C. to about 150° C. This heating of the coal in drying zone 10 is carried out for a time sufficient to remove at least about 90% by weight and preferably up to about 98% by weight and more of said moisture.

Drying zone 10 can comprise one or more of a variety of vessels in which the particulated coal can be dried to the extent described hereinabove. Representative, but non-limiting, examples of various vessels suitable for effecting the drying of the particulated coal include rotary, cascade, suspension and fluidized bed-type vessels and retorts and the like. Within such vessels, the particulated coal charge will be dried by either direct or indirect contact between said particulated coal and the heating medium employed therein for this purpose. Preferably, drying of the particulated coal charged to the vessel or vessels comprising drying zone 10 will be by direct contact between said particulated coal and the heating medium. By operating in this latter manner, not only is the rate of heat transfer between the particulated coal and heating medium greater, thereby reducing the time required to dry the particulated coal, but, also, the heating medium provides an efficient means for conveying the inherent water removed from the particulated coal away from said coal.

The heating medium employed in drying zone 10 can be any suitable gaseous material which has been heated (by means not shown) and is continuously introduced into drying zone 10 through conduit 4. Gaseous materials suitable for use in heating the particulated coal charged to drying zone 10 through conduit 2 include, but are not limited to, for example, flue gases resulting from the combustion of a fuel in a furnace (not shown), recycled gaseous by-products, and inert gases such as, for example, nitrogen and the like.

The gaseous heating medium can be introduced into drying zone 10 through conduit 4 in such a manner as to provide a continuous flow of said medium through said drying zone 10 either concurrent with or countercurrent to the flow of the particulated coal flowing through drying zone 10. Thus, although in the single FIGURE the gaseous heating medium is shown as entering the drying zone 10 through conduit 4 in a direction concurrent with the particulated coal being charged to drying zone 10, said heating medium also can be introduced to zone 10 in a direction countercurrent to that of the coal charge flowing through said drying zone 10.

The heating medium introduced into drying zone 10 is continuously withdrawn therefrom and introduced into gas treatment zone 28 through conduit 14. In said gas treatment zone 28, the coal-based water is removed and recovered from the heating medium. In a preferred embodiment, at least a portion of this recovered coal-based water then is conveyed through conduit 16 to emulsion preparation zone 36. The dried gaseous heating medium remaining then is removed from gas treatment zone 28 through conduit 11 and either exhausted to the atmosphere or reheated (by means not shown) and recycled and introduced into heating zone 10 through conduit 4.

The dried particulated coal is withdrawn from drying zone 10 through conduit 12. At least a portion of the dried particulated coal exiting drying zone 10 through conduit 12 is removed therefrom through communicating conduit 17 and introduced into pyrolysis zone 20.

The portion of the dried particulated coal introduced into pyrolysis zone 20, as illustrated in the single FIGURE, will be an amount which upon pyrolysis will provide at least 0.5% by weight of coal-based tar by-products calculated on the basis of the total weight of the material to be coated in emulsion treatment zone 30. As illustrated in the single FIGURE, the material being treated in emulsion treatment zone 30 comprises an admixture of the remaining portion of dried particulated coal from drying zone 10 and the coal-based char product from pyrolysis zone 20. This admixture is formed at the confluence of conduits 18 and 22 and conveyed to emulsion treatment zone 30 through communicating conduit 23. However, the material to be coated in emulsion treatment zone 30 also can comprise just the remaining portion of dried particulated coal from drying zone 10 since it is within the scope and spirit of this invention to provide for recovery of the particulated coal-based char as a separate and distinct product. The material to be coated in emulsion treatment zone 30 also can comprise just the coal-based char product from pyrolysis zone 20. In this embodiment, all or substantially all of the dried particulated coal removed from drying zone 10 by way of conduit 12 is conveyed and introduced into pyrolysis zone 20 through communicating conduit 17. Thus, it is the resultant solid particulated coal-based char product which is subsequently treated with the water-in-tar emulsion in emulsion treatment zone 30 to provide the final fuel product.

Referring once again to the single FIGURE, pyrolysis zone 20 can comprise any of one or more vessels suitable for pyrolyzing the portion of dried particulates coal introduced thereto through conduit 17 and for recovering separately the desired char product and the coal-based gaseous and tar by-products resulting from the pyrolysis of said dried particulated coal. Representative examples of suitable pyrolysis vessels include, but are not limited to, refractory ovens, rotary kilns, fluidized or entrained bed retorts, horizontal and vertical fixed and continous bed retorts and the like. Specific examples of various vessels which can be employed in pyrolysis zone 20 include those disclosed and described by H. H. Lowry, *Chemistry of Coal Utilization,* Supplement, pages 395–460 (1963), the teachings of which are incorporated herein by reference in their entirety.

The heating of at least a portion of the dried particulated coal introduced into pyrolysis zone 20 to pyrolysis temperatures can be carried out in a manner similar to that employed in drying zone 10, i.e., by either direct or indirect contact of the dried, particulated coal with a heating medium and preferably by direct contact between said particulated coal and the heating medium. In this latter regard, it is preferred to operate the pyrolysis zone 20 in a manner such that the flow of dried particulated coal and heating medium in pyrolysis zone 20 are countercurrent to one another as is illustrated in the single FIGURE. However, pyrolysis zone 20 also can be operated in a manner such that the flow of dried particulated coal and heating medium therein are concurrent.

The heating medium employed in pyrolysis zone 20 and introduced thereto through conduit 15 can be the same medium as that employed in drying zone 10. Thus, the heating medium employed in pyrolysis zone 20 to pyrolyze said dried particulated coal and to form the desired char product and coal-based gaseous and tar by-products will be a gaseous material such as, for example, flue gases, recycled gaseous by-products, e.g., the gaseous pyrolysis products recovered from pyrolysis zone 20 by way of conduit 26, and inert gases such as nitrogen and the like and combinations thereof. In addition to the aforementioned gaseous materials, steam also may be used to effect the heating and thus the pyrolysis of the portion of the dried particulated coal charged to pyrolysis zone 20. For reasons of economy and efficiency, the preferred heating mediums for use in pyrolysis zone 20 are the flue gases, recycled gaseous by-products or combinations of such gases.

The temperatures employed within pyrolysis zone 20 will be temperatures sufficient to effect pyrolysis of the dried particulated coal therein to the desired particulated coal-based char product and to maximize the formation of the desired coal-based tar by-products. Such temperatures generally will range from about 300° C. to about 600° C., with temperatures within the range of from about 350° C. to about 450° C. being preferred.

The heating medium, together with the coal-based gaseous by-products resulting from the pyrolysis of the dried particulated coal in pyrolysis zone 20, are withdrawn from said zone 20 through conduit 26. At least a portion of the heating medium/gaseous by-product mixture that is withdrawn may be recovered and reheated (by means not shown) and returned to pyrolysis zone 20 through conduit 15 to provide the heating medium for the pyrolysis of a fresh portion of dried particulated coal introduced into pyrolysis zone 20. Additionally, a portion of said heating medium/coal-based gaseous by-product mixture withdrawn through conduit 26 can be reheated and conveyed (by means not shown) directly to drying zone 10 or conveyed (by means not shown) to gas treatment zone 28, wherein it is combined with the heating medium recovered from drying zone 10.

The coal-based tar by-products resulting from the pyrolysis of the dried particulated coal in pyrolysis zone 20 are withdrawn from said zone 20 through conduit 24 and conveyed through said conduit 24 to emulsion preparation zone 36. In emulsion preparation zone 36, the coal-based tar by-products are combined with either the inherent water removed from the particulated coal in drying zone 10 and recovered in gas treatment zone 28 and introduced into emulsion preparation zone 36 by way of conduit 16 or water from an external source (not shown) or mixtures thereof. Within said emulsion preparation zone 36, said coal-based tar by-products and said water are admixed in such proportions as to provide a water-in-tar emulsion. In general, said coal-based tar by-products and said water are combined in such proportions as to provide an emulsion comprising at least about 10% by weight of said water. More particularly, the water-in-tar emulsions will comprise from about 10% to about 30% by weight of said water and from about 70% to about 90% by weight of said coal-based tar by-products based upon the weight of the total emulsion.

Emulsion preparation zone 36 can be any vessel suitable for preparing the above-described emulsions. Representative but non-limiting examples of such vessels include mixing tanks equipped with propellers, turbines or mechanical or electrical ultrasonic agitating means, colloid mills, homogenizing vessels and the like. A more completed description of various equipment useful in emulsion preparation zone 36 is found in Kirk-Othmer, *Encyclopedia of Chemical Technology,* 2nd Ed., Vol. 8, pp. 139–144 (1965) the disclosures therein being incorporated herein in their entirety.

The pyrolyzed particulated coal, i.e. particulated coal-based char, then is withdrawn from pyrolysis zone 20 through conduit 22 and combined with the remaining portion of the dried particulated coal withdrawn from drying zone 10, by way of communicating conduits 12 and 18, respectively, in conduit 23 to form an admixture. The admixture of the dried particulated coal from drying zone 10 and the particulated coal-based char from pyrolysis zone 20 then is transported through conduit 23, to emulsion treatment zone 30. In emulsion treatment zone 30, the admixture of dried particulated coal from heating zone 10 and particulated coal-based char from pyrolysis zone 20 is treated with from about 1.0% to about 20% by weight, based on the weight of the admixture being treated, of the water-in-tar emulsion from emulsion preparation zone 36. The water-in-tar emulsion from emulsion preparation zone 36 is introduced into emulsion treatment zone 30 through conduit 38. In said emulsion treatment zone 30, the water-in-tar emulsion is contacted with said admixture of dried particulated coal and particulated coal-based char at temperatures ranging from about 50° C. to about 600° C. and in a manner to provide the particulated coal and char in said admixture with a coating of the coal-based tar in said water-in-tar emulsion. Emulsion treatment zone 30 can comprise any vessel, container or arrangement of vessels and containers and other equipment, wherein the emulsion can be contacted with and applied to the admixture of particulated dried coal and char by known techniques such as, for example, spraying, slurrying, and the like. The resulting coated particulated coal/char product which is characterized by an improved heating value and substantially reduced tendencies to ignite spontaneously and undergo size degradation then is recovered by withdrawing said product from emulsion treatment zone 30 through conduit 32.

While the single FIGURE and written description specifically relate to the preparation of a carbonaceous-derived fuel product comprising an admixture of a carbonaceous material and a carbonaceous-based char, said mixture being coated with a carbonaceous-based tar by-product, it is understood that the novel method disclosed herein is also applicable to the preparation of carbonaceous fuel products comprising either the carbonaceous material or the carbonaceous-based char individually coated with a carbonaceous-based tar by-product.

The following example is offered for the purpose of illustrating the operation of the process of the present invention and not by way of limitation. In the following example, all parts and percentages are by weight, and all temperature in degrees centigrade unless indicated otherwise.

EXAMPLE 1

To a drying vessel equipped with gas inlet and outlet means are added 100.0 grams of as-mined Wyoming subbituminous coal ground to a particle size ranging from $-\frac{1}{4}''$ to $+8$ mesh. The coal contains about 30% by weight of inherent moisture and has a heating valve of approximately 8,000 Btu's/pound. In the drying vessel the coal is heated to a temperature of 100° C. and is maintained at this temperature for a period of about 3 hours. During the heating period, nitrogen gas is continuously introduced to and withdrawn from the drying vessel at a rate of flow of 250 milliliters per minute (ml/min.). The hot nitrogen withdrawn from the drying vessel is passed through a glass receiving vessel maintained at a temperature of −78° C. by means of a dry ice/methanol bath to condense and recover the inherent moisture removed from the coal sample. The dried coal has a moisture content of less than 0.5 percent by weight and a heating value of approximately 11,300 Btu's/pound.

Upon removal of the dried coal from the drying vessel, 50.0 grams of this dried coal then are placed in a pyrolysis furnace equipped with gas inlet and outlet means. The furnace is maintained at a temperature of 500° C. and nitrogen continuously is introduced into and withdrawn from the furnace at a rate of flow of 250 ml/min. Once the dried coal has reached the furnace temperature of 500° C., measured by means of a thermocouple inserted in the sample, it is held at this temperature for a period of 15 minutes. At the end of this time the resultant coal-based char is removed and combined with the remaining 50 grams of dried coal from above to form an admixture.

The hot nitrogen gas withdrawn from the pyrolysis furnace during pyrolysis of the dried coal therein is passed through two receiving vessels connected in series. Each vessel is immersed in a separate cooling bath wherein they are maintained at a temperature of −78° C. to condense the coal-based tars present in the gas.

From the water and coal-based tars recovered above, a water-in-oil emulsion is prepared by blending together 1.3 grams of water and 3.0 grams of the coal-based tar by-product in a stirred vessel which is heated to and maintained at a temperature of 50° C. To this vessel then is added 54.5 grams of the admixture of particulated dried coal and particulated char. Stirring is continued until such time as a homogenous mixture is obtained, i.e. until such time as the emulsion is observed to be completely adhered to or absorbed onto the surface of the particles of dried coal and char of the admixture. The coated admixture, upon cooling, contains about 2.5 percent by weight moisture and has a heating value of 11,300 Btu's/pound.

When compared to the uncoated dried coal and uncoated coal-based char alone, the coated admixture of dried coal and coal-based char exhibits improved, i.e., decreased, self-heating characteristics. For example, when heated in a constant temperature oven at 65.5° C. and then exposed to a relative humidity of about 95%, a 50 gram sample of the above prepared coated admixture undergoes a temperature increase of only about 9° C. over a 15 minute period. By comparison, when the uncoated dried coal and uncoated coal-based char alone are subjected to the same temperature, humidity and time conditions, temperature increase of 23° C. and 22° C. respectively, are encountered. This lower self-heating property exhibited by the coated admixture, means that the coated admixture possesses a significantly reduced tendency to ignite spontaneously during storage compared to either the uncoated dried coals or uncoated coal-based chars alone.

Also by comparison, when these same dried coals and coal-based chars are coated directly with said coal-based tar by-products and not by use of a water-in-tar emulsion prepared from said coal-based tar by-products, the self-heating temperature increases exhibited by such coated dried coals and coated coal-based chars are 16° C. and 17° C., respectively. Although these temperatures represent an improvement over those of the uncoated test materials, the further observed decrease in self-heating temperature for the above admixture through the application of the coal-based tar by-products to said admixture in the form of a water-in-tar emulsion is totally unexpected.

Further, when compared to the uncoated coal and uncoated coal-based char alone, the coated admixture exhibits a reduced tendency to undergo size degradation to fines, i.e., the coated admixture is less friable. To demonstrate this reduced tendency to undergo size degradation, 10 gram samples of each of the dried coal, coal-based char and and coated admixture recovered from the above example are dropped three times from a height of four feet through a plastic pipe onto a metal pan. Each of the test samples contains particles ranging in size from −¼" to +8 mesh. At the end of the third drop, each sample then is resized to determine the extent of particle size degradation that it has undergone. Upon resizing, it is found that 3.2% by weight of the uncoated dried coal will pass a 20 mesh screen, 1.4% by weight of the uncoated, coal-based char will pass such size screen and only 1.0% by weight of the coated admixture will pass such size screen. These tests demonstrate the improved handling characteristics of the solid fuel products produced by the method of the present invention.

While the process of the present invention has been described in detail with respect to that which at present is considered to be the preferred embodiments thereof, it is to be understood that changes and modifications can be made to the process without departing from the spirit and scope of the invention as described above and as defined by the following claims.

What is claimed is:

1. A process for preparing a solid, particulated carbonaceous fuel composite having an improved heating value and substantially reduced tendencies to ignite spontaneously and undergo particle size degradation, consisting essentially of:

drying a solid, particulated carbonaceous material ranging in size from about two inches to about +8 mesh by heating said material at a temperature ranging from about 100° C. to about 150° C. to remove and recover a substantial portion of inherent water in said particulated carbonaceous material and provide a dried, particulated carbonaceous material having a reduced water content;

pyrolyzing at least a portion of said dried, particulated carbonaceous material by heating said material at a temperature sufficient to pyrolyze said portion to a particulated carbonaceous-based char material and to simultaneously recover from said portion carbonaceous-based tar by-products, said portion of dried, particulated carbonaceous material being an amount which upon pyrolysis will provide at least about 0.5% by weight of said carbonaceous-based tar by-products based upon the weight of a material to be contacted with a water-in-tar emulsion, said material and said water-in-tar emulsion being defined hereinbelow;

providing a water-in-tar emulsion prepared from said recovered carbonaceous-based tar by-products;

contacting said water-in-tar emulsion with at least one material selected from the group consisting of said dried, particulated carbonaceous material and a mixture of said dried, particulated carbonaceous material and said particulated carbonaceous-based char material at a temperature ranging from about 50° C. to about 600° C. to provide said solid, particulated carbonaceous fuel composite; and recovering said solid, particulated carbonaceous fuel composite.

2. The process of claim 1 wherein said portion of dried particulated carbonaceous material is subjected to pyrolysis temperatures ranging from about 300° C. to about 600° C.

3. The process of claim 1 wherein said water-in-tar emulsion comprises from about 10% to about 30% by weight of said recovered inherent water and from about 70% to about 90% of said recovered carbonaceous-based tar by-products.

4. The process of claim 1 wherein the contacting of said water-in-tar emulsion with at least one material selected from the group consisting of said dried, particulated carbonaceous-based material comprises contacting from about 1.0% to about 20% by weight of said emulsion with said material based on the weight of said material.

5. The process of claim 4 wherein the material contacted with said emulsion is an admixture of said dried, particulated carbonaceous and said particulated, carbonaceous-based char material.

6. The process of claim 1 wherein said solid particulated carbonaceous material is a coal selected from the group consisting of subbituminous, lignite and brown coals.

7. The process of claim 6 wherein said coal is a subbituminous coal containing from about 20% to about 70% by weight of inherent water.

8. A particulated solid fuel composite prepared in accordance with the process of claim 1 having an improved heating value and substantially reduced tendencies to ignite spontaneously and undergo size degradation, said composite comprising a substrate consisting of at least one particulated carbonaceous material selected from the group consisting of dried subbituminous, lignite and brown coals and chars produced by the pyrolysis of said coals; and a coating on said substrate of particulated carbonaceous material of at least about 0.5% by weight, based on the total weight of the particulated carbonaceous material, of a tar, said tar being a by-product of the pyrolysis of said carbonaceous material, said coating being applied to said substrate as a water-in-tar emulsion.

9. The particulated solid fuel composite of claim 8 wherein said substrate comprises an admixture of a dried particulated subbituminous coal and a particulated char produced therefrom.

10. The composite of claim 9 wherein said dried particulated subbituminous coal is prepared by heating a particulated as-mined subbituminous coal containing from about 20% to about 70% by weight of inherent water at temperatures ranging from about 100° C. to about 150° C. to remove from said as-mined coal at least about 90% by weight of the inherent water in said as-mined coal.

11. The composite of claim 10 wherein said particulated char is prepared by pyrolysis of at least a portion of said dried particulated subbituminous coal at a temperature ranging from about 300° C. to about 600° C.

12. The composite of claim 11 wherein the portion of said dried particulated subbituminous coal utilized to prepare said particulated char is an amount sufficient to provide at least about 0.5% by weight of the tar by-product comprising said coating.

13. The composite of claim 12 wherein said coating is applied to said substrate as a water-in-tar emulsion containing from about 10% to about 30% by weight of water and from about 70% to about 90% by weight of said tar by-product.

14. The composite of claim 12 wherein said water utilized to prepare said water-in-tar emulsion is said inherent water removed by heating said particulated as-mined subbituminous coal.

* * * * *

UNITED STATES PATENT AND TRADEMARK OFFICE

CERTIFICATE OF CORRECTION

PATENT NO. : 4,605,421

DATED : August 12, 1986

INVENTOR(S) : Kauffman, et al.

It is certified that error appears in the above-identified patent and that said Letters Patent are hereby corrected as shown below:

The Assignee should read --Kerr-McGee Coal Corporation--

Signed and Sealed this

Eleventh Day of November, 1986

*Attest:*

DONALD J. QUIGG

*Attesting Officer*

*Commissioner of Patents and Trademarks*